United States Patent [19]

Walters

[11] Patent Number: 4,783,961

[45] Date of Patent: Nov. 15, 1988

[54] NATURAL GAS PRESSURE DIFFERENTIAL ENERGY RECOVERY SYSTEM

[76] Inventor: Randall W. Walters, 707 S. Main, Rice Lake, Wis. 54868

[21] Appl. No.: 145,660

[22] Filed: Jan. 13, 1988

Related U.S. Application Data

[63] Continuation of Ser. No. 63,159, Jun. 16, 1987, abandoned.

[51] Int. Cl.[4] ..... F15B 13/02; F15B 21/04

[52] U.S. Cl. ..... 60/370; 60/407; 60/495; 91/4 R; 417/375; 417/397; 417/401

[58] Field of Search ..... 48/191; 261/123; 60/325, 370, 372, 407, 423, 495, 496; 91/4 R, 4 A, 398; 92/162 R; 417/375, 397, 401

[56] References Cited

U.S. PATENT DOCUMENTS

| | | | |
|---|---|---|---|
| 3,100,965 | 8/1963 | Blackburn | 60/375 |
| 3,803,847 | 4/1974 | McAlister | 60/721 |
| 3,901,033 | 8/1975 | McAlister | 60/516 |
| 3,942,323 | 3/1976 | Maillet | 60/413 |
| 4,097,198 | 6/1978 | Herron | 417/401 X |
| 4,207,741 | 6/1980 | Rainey | 60/496 |
| 4,208,878 | 6/1980 | Rainey | 60/496 |
| 4,267,695 | 5/1981 | Micciche | 60/473 |
| 4,399,368 | 8/1983 | Bucknam | 60/721 X |
| 4,683,720 | 8/1987 | De Shon | 60/495 X |
| 4,698,968 | 10/1987 | Mestieri | 60/372 |

FOREIGN PATENT DOCUMENTS

| | | | |
|---|---|---|---|
| 3313642 | 10/1984 | Fed. Rep. of Germany | 60/495 |

*Primary Examiner*—Robert E. Garrett
*Assistant Examiner*—George Kapsalas
*Attorney, Agent, or Firm*—Merchant, Gould, Smith, Edell, Welter & Schmidt

[57] ABSTRACT

An energy recovery system is disclosed for recovering energy of highly pressurized natural gas when it is depressurized prior to distribution. The system includes a processing vessel which defines a bounded volume. The vessel is partially filled with water. A shaft extends through an aperture formed in the processing vessel with the shaft reciprocally moveable through said aperture. A conduit connects the high pressure natural gas to a gas inlet disposed within the processing vessel. The inlet is disposed beneath the level of the water within the vessel. Gas flows from the inlet in a predetermined path toward the water level. An exhaust conduit connects an outlet of the processing vessel to an expansion tank. The outlet is disposed above the water level within the vessel. A lift chamber is connected to the shaft and has an opening disposed to admit gas flowing along the predetermined path. The chamber is sized for gas collected within the chamber to urge the shaft to move toward the water level. Valves are provided for releasing collected gas from the chamber when the shaft has moved to a predetermined location. As a result, the shaft continuously reciprocates within the processing vessel as pressurized gas flows to the expansion tank for depressurization. The reciprocating movement of the shaft is utilized to translate the mechanical movement into usable energy for performing work.

14 Claims, 3 Drawing Sheets

NATURAL GAS PRESSURE DIFFERENTIAL ENERGY RECOVERY SYSTEM

This is a continuation of application Ser. No. 63,159, filed June 16, 1987, now abandoned.

BACKGROUND OF THE INVENTION

The present invention relates to the field of using compressed gas to do work. More particularly, the present invention relates to a system for utilizing energy of highly compressed natural gas when the gas is depressurized prior to its distribution.

In a natural gas distribution system, natural gas is stored in substation tanks at high pressures. Commonly, such pressures may exceed 1,000 psi. The natural gas is distributed to customers at a relatively low pressure. For example, an initial depressurization of the natural gas may lower its pressure to about 50 psi.

The high pressure natural gas represents substantial potential energy. Presently, it is believed that the full potential of this energy is not utilized when depressurizing the gas prior to its distribution. It is an object of the present invention to provide a system for recovery of the potential energy of the highly pressurized gas as its pressure is reduced prior to its distribution.

SUMMARY OF THE INVENTION

According to a preferred embodiment of the present invention, there is provided an energy recovery system which includes a processing vessel having walls which define a bounded volume. The vessel is partially filled with a liquid. A shaft extends through an aperture formed in the processing vessel with the shaft terminating at a free end within the vessel. The aperture is sealed to accommodate reciprocating movement of the shaft through the aperture. A source of high pressure natural gas is provided as is an expansion tank having a gas inlet and a gas outlet. A high pressure conduit connects the source of pressurized gas with a gas inlet of the processing vessel. The gas inlet is disposed beneath a level of the liquid within the vessel. Accordingly, gas admitted to the inlet has a tendency to flow in a predetermined path from the gas inlet to the level of the liquid.

An exhaust conduit connects an outlet of the processing vessel in gas flow communication with the gas inlet of the expansion tank. The gas outlet is disposed above the liquid level.

A lifting chamber is secured to the shaft for movement with the shaft. The lifting chamber has an opening disposed to admit into the chamber gas flowing in the predetermined path. The lifting chamber is sized for gas collected within the chamber to urge the shaft toward the liquid level. Means are provided for discharging gas from the chamber when the shaft has moved to a predetermined location.

As a result of the structure of the present invention, gas may be collected in the chamber and the shaft may be moved to the predetermined location. When the shaft achieves the predetermined location, gas is discharged from the chamber and the shaft moves away from the predetermined location. This cycle is repeated resulting in reciprocating motion of the shaft which may be utilized to perform desired work.

DESCRIPTION OF THE PREFERRED EMBODIMENT

With reference now to the various figures in which similar elements are numbered identically throughout, the system of the present invention will now be described. Particularly, with reference to FIGS. 1 and 3, the system of the present invention will be described with reference to a first preferred embodiment.

Figure 1:
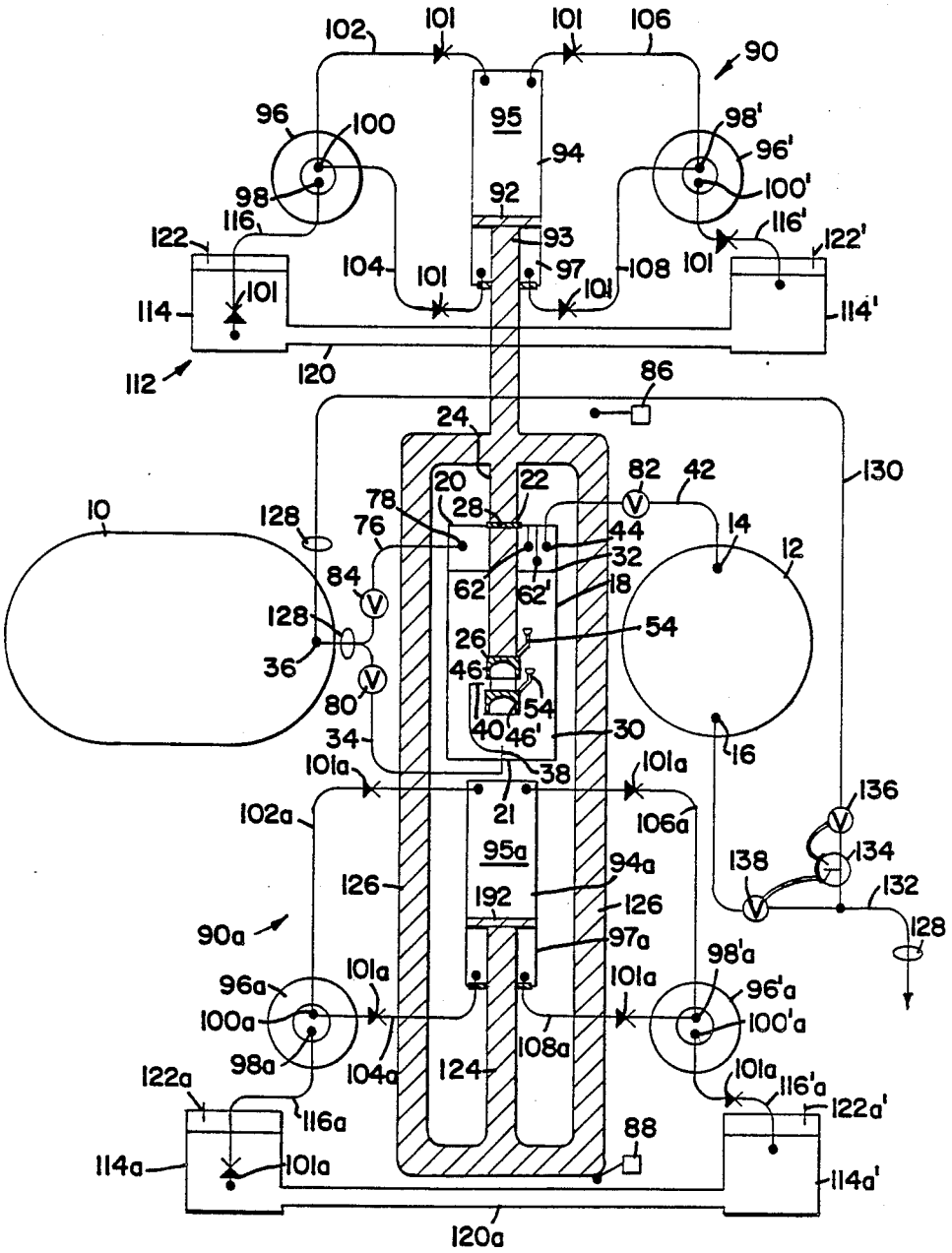
FIG. 1 is a schematic representation of a first preferred embodiment of a system according to the present invention for recovery of pressure differential energy of a pressurized natural gas.

In FIG. 1, a source of pressurized natural gas is shown schematically in the form of a pressurized gas tank 10. In a preferred embodiment, pressurized gas tank 10 is high pressure natural gas having pressures of approximately 750 to 1,000 psi or more prior to distribution of the gas at a natural gas substation.

An expansion tank 12 is schematically shown having an inlet 14 and an outlet 16. Expansion tank 12 receives pressurized gas from inlet 14. The pressurized gas may assume a larger volume within expansion tank 12 thereby reducing its pressure prior to being exhausted through outlet 16.

A processing vessel 18 is provided. Processing vessel 18 is cylindrical and is disposed with a vertical cylindrical axis. In the embodiment of FIG. 1, the upper axial face 20 of processing vessel 18 is provided with an axially disposed aperture 22 which is sized to receive an axially extending shaft 24. Shaft 24 terminates at a free end 26 within the bounded interior of processing vessel 18. Any suitable seal 28 seals aperture 22 and accommodates reciprocating movement of shaft 24 through aperture 22 in the direction of the axis of the shaft and processing vessel 18.

A liquid 30 is provided within the processing vessel 18 to partially fill vessel 18 with the liquid 30 assuming a level 32. In a preferred embodiment, liquid 30 is water since it is believed that natural gas does not readily dissolve in water as it might in other liquids.

An exhaust conduit 42 is provided for connecting an outlet 44 of processing vessel 18 to expansion tank inlet 14 in gas flow communication. The outlet 44 is disposed in the volume of vessel 18 between water level 32 and upper axial face 20.

A high pressure conduit 34 connects an outlet 36 of natural gas tank 10 with a first gas inlet 38 of processing vessel 18. The first gas inlet 38 is disposed near the bottom axial face 21 of processing vessel 18. So disposed, gas admitted to first gas inlet 38 has a tendency to flow in a predetermined straight path from the first gas inlet 38 toward water level 32.

A second high pressure conduit 76 is provided connecting gas tank outlet 36 with a second inlet 78 disposed within vessel 18 above water level 32. A plurality of valves 80, 82 and 84 are disposed within conduits 34, 42 and 76, respectively, to selectively open and close the conduits.

Figure 3:
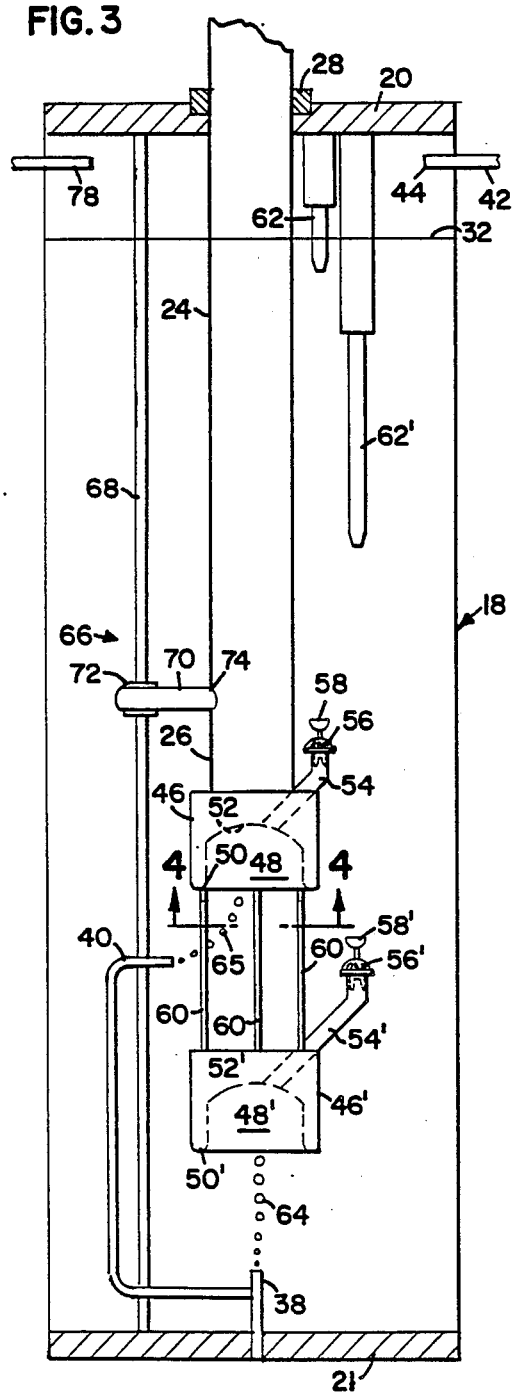
FIG. 3 is an enlarged view of a portion of an apparatus for use in the system of FIG. 1.
Figure 4:
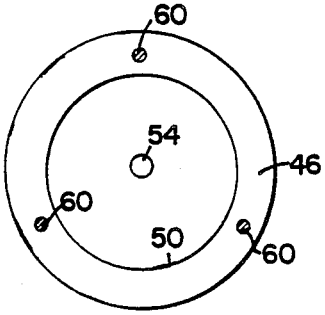
FIG. 4 is a view taken along lines 4–4 of FIG. 3.

As shown, in the preferred embodiment of FIGS. 1 and 3, first gas inlet 38 is axially disposed so that the predetermined path of the gas is to flow upwardly toward level 32 along the axis of vessel 18. First gas inlet 38 also includes a secondary component 40 which is disposed axially above inlet 38 and align to project a flow of gas radially toward the axis of vessel 18.

Shown most clearly in FIG. 3, free end 26 of shaft 24 is connected to a pair of displacement chamber cups 46 and 46'. Each of cups 46 and 46' is identical and the description of cup 46 will suffice of a description of 46'.

Cup 46 includes an internal expansion chamber 48 having an opening 50. Cup 46 is secured to free end 26 such that chamber 48 is disposed with opening 50 being axially aligned with the axis of shaft 24 and opposing the bottom axial face 21 of processing vessel 18.

Cup 46 has a concave roof 52 which is axially aligned with shaft 24. A discharge port 54 extends radially and upwardly away from cup roof 52 and terminates a valve 56 disposed exterior of cup 46. Valve 56 is preferably resiliently biased to normally close port 54 and includes a pin engaging cup 58 which, upon depression, opens port 54 to connect chamber 48 in gas flow communication with the interior of processing vessel 18.

Cup 48' is axially displaced beneath cup 48 and rigidly supported therefrom and connected thereto by a plurality of connecting pins 60. Port 54' is longer than port 54 so that cup 58' is spaced offset to the side of cup 58.

A pair of push rods 62 and 62' extend downwardly from upper axial face 20 with push rod 62 opposing cup 58 and push rod 62' opposing cup 58'. Push rods 62 and 62' have a length selected such that when shaft 24 has risen to a predetermined location (as will be described) the free ends of push rods 62 and 62' engage cups 58 and 58' to urge valves 56 and 56' against their natural bias to open ports 54 and 54'.

As shown in FIG. 3, gas projected from outlet 38 travels in a predetermined path 64 which is coaxial with the axis of shaft 24. Cup 46' is positioned for the gas path 64 to flow into chamber 48'. Outlet 40 is positioned to inject gas radially toward the axis of the shaft with the natural buoyancy of the gas causing it to assume a predetermined path 65. Chamber 48 is positioned to capture gas flowing along path 65.

To ensure proper alignment of cups 58, 58' with push rods 62, 62', a guide system 66 (shown only in FIG. 3) is provided. Guide system 66 includes a guide rod 68 secured to and extending between upper axial face 20 and lower axial face 21. Guide rod 68 is disposed to be parallel to the axis of shaft 24. A guide bracket 70 is provided with a first end 72 slidably received on guide rod 68 and a second end 74 fixedly secured to shaft 24. The guide system 66 prevents shaft 24 from rotating about its axis thereby moving cups 58 and 58' out of alignment with push rods 62, 62'.

In operation of the processing vessel 18, valve 82 is initially closed and shaft 24 is disposed in the position shown in FIG. 3 with cup 58, 58' spaced from push rods 62, 62'. Valves 80 and 84 are opened to admit gas to outlets 78, 38 and 40.

In order to propel gas through outlets 38 and 40, the gas pressure at outlet 78 must be less than the gas pressure at outlets 38 and 40. This may be accomplished in one of two ways. First, valve 84 may be closed while valve 80 is open until chambers 48 and 48' are filled. At this point, valve 80 may be closed and valve 84 may be opened to provide a head pressure to the volume of the processing vessel above water level 32. Alternatively, valve 84 may be partially open to provide less than full pressure above water level 32 while valve 80 is completely open to provide a pressure differential between outlet 78 and outlets 38, 40. In either event, gas from outlets 38 and 40 fills chambers 48', 48, respectively and gas from tank 10 provides a pressure head above water level 32.

The pressure head and the gas within chambers 48, 48' cooperate to urge shaft 24 upwardly. Shaft 24 moves upwardly until push rods 62, 62' engage cups 58, 58' to open ports 54, 54'. With the ports open, the gas within chambers 48, 48' is evacuated to the volume of vessel 18 above water level 32. When shaft 24 has reached this predetermined position, a first limit switch 86 (or any other position detecting mechanism) is tripped indicating that the desired predetermined position has been attained. With this position attained, valve 84 is closed. Simultaneously, valve 82 is opened to evacuate the high pressure gas through conduit 42 into expansion tank 12. With the gas evacuated from chambers 48, 48' and discharging through line 42, the weight of shaft 24 causes it to drop to the position shown in FIG. 3. Alternatively, any power operated means (such as fluid pressure actuators) can be incorporated into the design to force the shaft 24 to move to the position of FIG. 3.

When the position of FIG. 3 is achieved, a second limit switch 88 is tripped indicating that valve 82 may be closed and valve 80 and 84 may be opened in the manner previously described. Accordingly, processing vessel 18 may be used to provide reciprocating motion of shaft 24 within aperture 22.

The reciprocating movement of shaft 24 may be used to perform work. A preferred apparatus for recovering the energy represented by the motion of shaft 24 is a hydraulic motor system indicated generally at 90. The hydraulic motor system includes a piston head 92 carried on the end 93 of shaft 24 exterior of processing vessel 18. Piston head 92 is disposed within a pressure cylinder 94 with head 92 separating cylinder 94 into a first pressure chamber 95 and a second pressure chamber 97.

First and second fluid actuated motors 96 and 96', respectively, are provided. Motors 96, 96' are provided with fluid inlets 98, 98' and fluid outlets 100, 100'. Motors 96, 96' form no part of this invention per se and are well known in the art. Motor 96 is preferably a negative pressure motor such that a suction on outlet 100 draws a fluid through inlet 98 which drives motor 96. Conversely, motor 96' is a positive pressure motor such that the admission of a fluid under pressure to inlet 98' passes through motor 96' in route to outlet 100'. The fluid passing from inlet 98' to outlet 100' drives motor 96'.

Outlet 100 is connected to first pressure chamber 95 by a first outlet motor conduit 102. A second outlet motor conduit 104 connects outlet 100 with the second pressure chamber 97.

A first motor inlet conduit 106 connects an inlet 98' of motor 96' with the first high pressure chamber 95. A second inlet motor conduit 108 connects inlet 98' with the second pressure chamber 97.

Flow direction control valves 101 (preferably check valves) are disposed in each of lines 102, 104, 106 and 108. The valves 101 in lines 102 and 104 are positioned to block flow from cylinder 94 to outlet 100, but to permit flow from outlet 100 to cylinder 94. Conversely, valves 101 in lines 106 and 108 are positioned to permit flow from cylinder 94 to inlet 98' but block flow from inlet 98' back to cylinder 94.

A source of hydraulic fluid is shown generally at 112 and includes first and second reservoirs 114 and 114'. An inlet conduit 116 connects motor inlet 98 with first reservoir 114. Similarly, an outlet conduit 116' connects motor outlet 100' with second reservoir 114'. Flow control valves 101 are disposed in each of lines 116 and 116'. The valve 101 in line 116 is positioned to permit flow from reservoir 114 to motor inlet 98 but block reverse flow. Conversely, valve 101 in line 116' is positioned to permit flow from outlet 100' to second reservoir 114' but block reverse flow.

Reservoirs 114 and 114' are connected in fluid flow communication by a heat exchanger which is shown schematically at 120. Heat exchanger 120 may simply be an elongated pipe having sufficient surface area to cool fluid flowing from second reservoir 114' to first reservoir 114. Or, alternatively, heat exchanger 120 may include any suitable heat exchange means such as a water cooling jacket, cooling fins, blowers or the like.

In operation, the hydraulic motor system 90 utilizes the energy of the reciprocating shaft 24. As the shaft 24 moves upwardly in the view of FIG. 1, fluid within pressure chamber 95 is forced through line 106 to drive motor 96'. The motor fluid is passed into second reservoir 114'. Simultaneously, a suction within pressure chamber 97 draws fluid from reservoir 114 through motor 96 with the fluid being drawn through line 104 into second pressure chamber 97.

As shaft 24 moves downwardly, fluid within pressure chamber 97 is passed through motor 96' and into second reservoir 114'. Simultaneously, fluid is drawn under suction from reservoir 114 through motor 96 and into first pressure chamber 95. As a result, in both the downward and upward stroke of shaft 24, fluid is being drawn through both of motors 96 and 96' to drive the motors. The driven motors may perform work in any suitable manner or may be connected to a generator (now shown) for generating electricity. The motive fluid becomes heated as it passes through the motors and the fluid is cooled as it passes from reservoir 114' through heat exchanger 120 to reservoir 114'. Both of reservoirs 114, 114' are provided with air vents 122, 122' to maintain the hydraulic motor system 90 at atmospheric pressure.

With large pressure, large volume gases, a second hydraulic motor system **90*a* may be coupled with first system 90. In the second system 90*a*, a secondary shaft 124 is connected to shaft 24 by means of intermediate connecting arms 126. Accordingly, shaft 124 moves with shaft 24**.

Shaft 124 is provided with a piston head 192. To recover the energy of the moving shaft 124 and piston head 192, the hydraulic motor system **90*a* includes motors, fluid reservoirs and a pressure cylinder which are identical to those shown with respect to the first hydraulic motor system 90. Accordingly, similar elements of system 90*a* are numbered identically to those of system 90 with the addition of the suffix "a". The description of the elements of hydraulic motor system 90 will suffice as the description of the elements of 90*a*. It will appreciated that as the volume and pressure of the gases acting of shaft 24 increase, the number of hydraulic motor systems such as systems 90 and 90*a*** may be increased.

In operation of the apparatus, it is desirable to provide the apparatus with auxiliary equipment to ensure smooth operation. For example, pressure regulators 128 are provided to ensure uniform pressure during operation of the system. Further, a bypass line 130 is provided to provide bypass of high pressure gas from tank outlet 36 to a final distribution conduit 132. The final distribution conduit 132 is connected directly to expansion tank outlet 16. Bypass 130 permits a make up of the distribution gas with high pressure gas to ensure a uniform desired pressure in output line 132. In this regard, a pressure sensing means 134 is provided to determine gas pressure and to operate control valves 136, 138 to maintain a desired mix of pressurized gas in final distribution line 132. It will be appreciated that pressure regulators such as regulator 128 and bypass system such as bypass 130 with pressure sensor 134 and valves 138 and 136 are well known in the art and form no part of this invention per se.

From the foregoing, it has been seen how the object of the invention have been attained in a first preferred embodiment. The high pressure gas from tank 10 is reduced in pressure upon admittance to expansion tank 12. However, intermediate to its admittance to expansion tank 12, the gas goes through a preliminary expansion in the process of lifting shaft 24. The lifting motion of the shaft 24 together with its reverse fall, creates a reciprocating motion which can be used to drive hydraulic motor system 90. For applications having large volume gas and large pressures, numerous hydraulic motor systems 90 and **90*a* can be connected to a common shaft 24 with a single processing vessel 18. As a result of connecting the hydraulic motor systems 90 and 90*a* to the moving shaft 24, the potential energy of the high pressurized gas is converted to useful work in the form of the output of motors 96, 96*a*, 96' and 96*a*'**.

Figure 2:
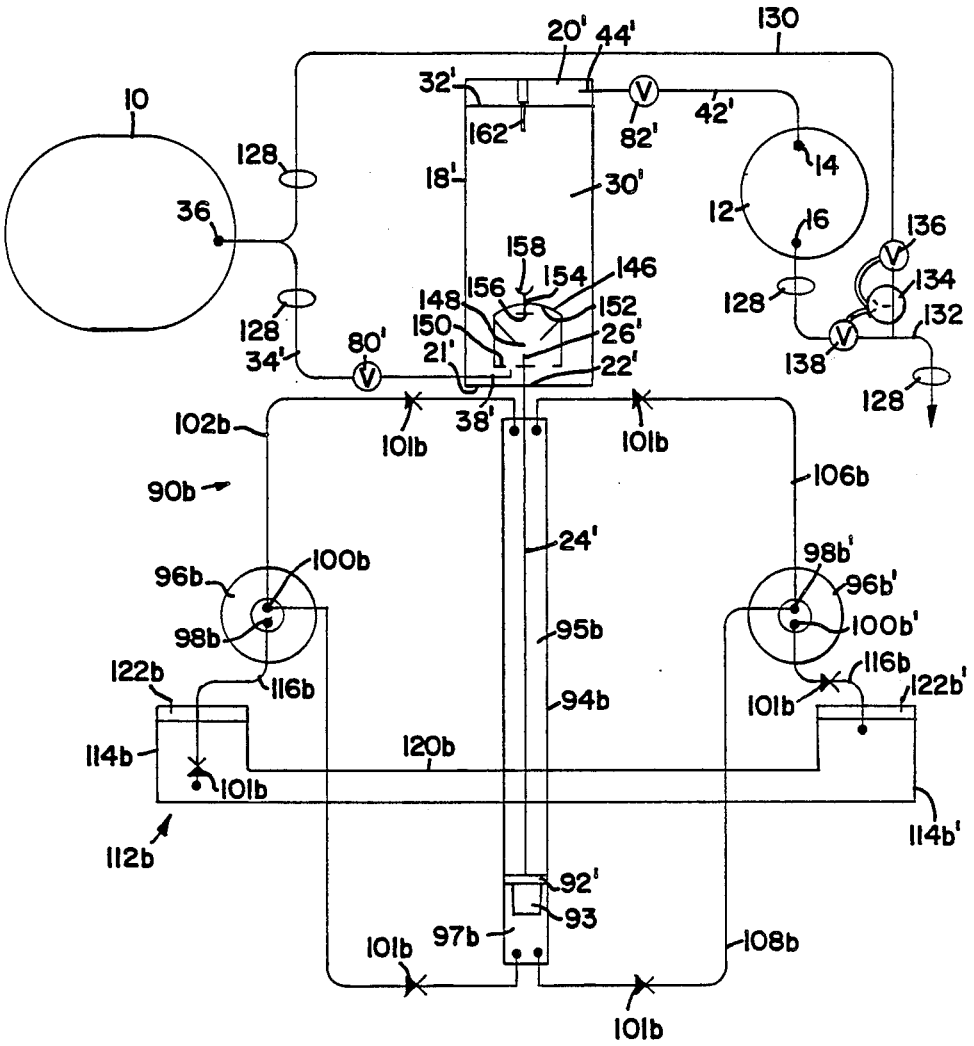
FIG. 2 is a schematic representation of a second preferred embodiment of a recovery system of the present invention.

FIG. 2 shows an alternative embodiment of the present invention in a schematic format. Like the system of FIG. 1, the system of FIG. 2 includes a pressurized gas tank 10 with a gas outlet 36 as well as an expansion tank 12 with an inlet 14 and outlet 16. A final distribution conduit 132 is connected to outlet 16 and a bypass conduit 130 connects gas tank outlet 36 with distribution conduit 132. Pressure sensing means 134 and valves 136, 138 as well as regulator 128 are provided for the same functions as previously described with reference to the embodiment of FIG. 1.

The embodiment of FIG. 2 includes a processing vessel 18' which is similar to that of processing vessel 18. Processing vessel 18' is partially filled with water 30'. The water assumes a level 32'.

Processing vessel 18' includes an aperture 22' formed on its bottom axial face 21'. A shaft 24' extends through aperture 22' and is reciprocally movable along its axis in a direction coaxial with the axis of processing vessel 18'.

An enlarged chamber cup 146 is connected to a free end 26' of shaft 24' and defines a chamber 148 having openings 150 opposing bottom axial face 22'. The displacement chamber cup 146 has a concave roof 152 which includes a discharge port 154. Discharge port 154 includes a valve 156 having a pin engaging cup 158 which is axially disposed within vessel 18. Secured to upper axial face 20' is a push rod 162 opposing pin engaging cup 158.

A gas inlet 38' is disposed within vessel 18' for gas flowing from inlet 38' to pass through opening 150 and be collected within chamber 148. Inlet 38' is connected via conduit 34' to outlet 36 of pressurized gas tank 10. A valve 80' controls the flow of gas through conduit 34'. A gas outlet 44' is disposed within vessel 18' above water level 32'. Outlet 44' is connected via a conduit 42' to the inlet 14 of expansion tank 12. A valve 82' is disposed within conduit 42' to control the flow of gas through conduit 42'.

Processing vessel 18' functions in much the same manner as processing vessel 18 of the embodiment of FIG. 1. Namely, with chamber cup 146 in its lower position as shown in FIG. 2, valve 80' is open. Gas flows from inlet 38' into chamber 148 displacing the gas within the chamber and causing the chamber and its connected shaft 24' to rise. Valve 80' is open long enough to displace chamber fluid, it is then closed and remains closed until the next cycle. When the chamber approaches water level 32', push rod 162 opens valve 156 causing the collected gas within chamber 148 to evacuate into the volume of vessel 18' above water level 32'. Any suitable means, such as limit switches, (not shown) detect when the chamber cup 146 has reached its highest position. At this point, valve 82' is opened and the gas is evacuated into expansion chamber 12. With the gas evacuated, the weight of shaft of 24' together with its piston head 92' and associated weighted mass 93 cause shaft 24' to fall to its position shown in FIG. 2. At this point, valve 80' is opened to thereby repeat the cycle.

To recover the energy of the moving shaft 24', a hydraulic motor system **90*b* is provided which includes a cylinder 94*b* surrounding piston head 92' and its associated mass 93. The piston head 92' separates cylinder 94*b* into a first pressure chamber 95*b* and a second pressure chamber 97*b*. The hydraulic motor system 90*b* includes negative and positive pressure hydraulic motors 96*b* and 96*b'* together with associated conduits and hydraulic reservoirs identical to that of hydraulic motor system of FIG. 1. Accordingly, corresponding elements are similarly numbered with the addition of the suffix "b". Since the apparatus of hydraulic motor system 90*b* is the same as system 90, a description of system 90 will suffice as the description of system 90*b***.

From the foregoing detailed description of the present invention, it has been shown how the objects of the invention have been attained in a preferred manner. However, modifications and equivalence of the disclosed concepts such as readily occur to those skilled in the art are intended to be included in the scope of this invention. Thus, the scope of the invention is intended to be limited only by the scope of the claims as are, or may hereafter be, appended hereto.

I claim:

1. An energy recovery system comprising:

a processing vessel (18,18') having wall means defining a bounded volume, said volume at least partially filled with a liquid (30,30');

a shaft (24,24') extending through an aperture (22,22') formed in said processing vessel, said shaft terminating at a free end disposed within said processing vessel, means for sealing said aperture and accommodating reciprocating movement of said shaft through said aperture;

a source (10) of a pressurized gas;

an expansion tank (12) having a gas inlet (14) and a gas outlet (16);

first high pressure conduit means (34,34') for connecting said pressurized gas source in gas flow communication with a first gas inlet (38,38') of said processing vessel (18,18'), said first gas inlet disposed beneath a level (32,32') of said liquid within said processing vessel (18,18') for said gas admitted to said first gas inlet (38,38') to have a tendency to flow in a predetermined path from said first gas inlet to said level (32,32') of said liquid;

exhaust conduit means (42,42') for connecting an outlet (44,44') of said processing vessel (18,18') in gas flow communication with said gas inlet (14) of said expansion tank, said processing vessel oulet disposed above said level of said liquid;

lift chamber defining (146,46,46') means connected to said shaft (24,24') within said processing vessel to define a lift chamber (148,48,48') having a bounded volume with an opening (150,50,50') disposed for admitting into said lift chamber said gas flowing in said predetermined path, said chamber sized for gas collected within said chamber to urge said shaft free end toward said level (32,32') of said liquid;

gas discharge means (156, 56, 56') for releasing collected gas from said chamber when said free end of said shaft has moved toward said liquid level to a predetermined location;

whereby gas may be collected in said chamber and said shaft may be moved to said predetermined location with said shaft moving away from said predetermined location upon discharge of said collected gas from said chamber, said shaft thereby assuming a reciprocating motion which may be utilized to perform work.

2. A system according to claim 1 comprising energy recovery means for recovery of energy from said moving shaft.

3. An system according to claim 2 wherein said energy recovering means comprises a piston head connected to said shaft exterior of said processing vessel and disposed within an enclosed pressure cylinder;

a fluid driven motor having a fluid inlet and a fluid outlet with said motor driven by fluid passing from said meter inler to said meter outlet;

means for connecting said motor to said pressure cylinder for said piston head to urge fluid under pressure through said motor to drive said motor as said piston moves within said pressure cylinder.

4. A system according to claim 2 comprising:

a piston head connected to said shaft exterior of said processing vessel and disposed within an enclosed pressure cylinder with said piston head separating said pressure cylinder into first and second pressure chambers;

first and second hydraulic motors each having inlets and outlets with said motors operable to be driven by fluid passing from said motor inlets to said motor outlets;

a source of a fluid;

an inlet of said first motor connected to said fluid source in fluid flow communication;

an outlet of said second motor connected to said fluid source in fluid flow communication;

first outlet motor conduit means connecting said outlet of said first motor to said first pressure chamber in fluid flow communication;

second outlet motor conduit means connecting said outlet of said first motor to said second pressure chamber in fluid flow communication;

flow direction control means for each of said first and second outlet motor conduit means for blocking fluid flow to said first motor and permitting fluid flow from said first motor;

first inlet motor conduit means connecting said inlet of said second motor to said first pressure chamber in fluid flow communication;

second inlet motor conduit means connecting said inlet of said second motor to said second pressure chamber in fluid flow communication; and flow direction control means for each of said first and second inlet motor conduit means for blocking fluid flow from said second motor and permitting fluid flow to said second motor.

5. A system according to claim 4 wherein said source of fluid includes fluid coolant means for cooling a fluid from said outlet of said second motor to said inlet of said first motor.

6. A system according to claim 1 comprising alignment means for maintaining said lift chamber defining means in alignment with said predetermined path of said gas flowing from said first gas outlet to said level of said liquid.

7. A system according to claim 6 wherein said alignment means comprises a guide rod fixedly disposed within said processing vessel and generally parallel to a direction of travel of said shaft;

connecting means slidably received on said guide rod and fixably received to said shaft.

8. A system according to claim 1 wherein said aperture is disposed above said level of liquid and said shaft extends upwardly from said processing vessel.

9. A system according to claim 8 wherein said gas discharge means comprises a port in said chamber with valve means resiliently biased to normally close said port;

means disposed within said processing vessel to urge said valve means against its bias to open said port when said free end of said shaft has moved toward the predetermined location.

10. A system according to claim 8 comprising conduit means for admitting gas under pressure to a volume within said processing vessel disposed above said level of said liquid.

11. A system according to claim 1 wherein said aperture is disposed below said level of said liquid and said shaft extends beneath said processing vessel.

12. An energy recovery system for recovering energy from a high pressurized natural gas comprising:

a processing vessel having wall means defining a bounded volume, said volume at least partially filled with a liquid;

a shaft extending through an aperture formed in said processing vessel, said shaft terminating at a free end disposed within said processing vessel, means for sealing said aperture and accomodating reciprocating movement of said shaft through said aperture;

a source of a pressurized natural gas;

an expansion tank having a gas inlet to receive pressurized natural gas and reduce pressure of gas admitted to said expansion tank;

a high pressure conduit means for connecting said pressurized gas source in gas flow communication with a gas inlet of said processing vessel, said gas inlet disposed to admit gas to flow and collect in a volume of said processing vessel above a level of said liquid within said processing vessel with gas within said volume urging said shaft free end to move toward said level of said liquid;

gas discharge means for releasing gas from said volume and admitting said released gas said expansion tank when said free end of said shaft has moved towards said level of said liquid to a predetermined location;

means for blocking flow of gas from said volume to said expansion tank after said gas has been discharged to permit said shaft to move away from said level of said liquid to a first position; and means for recovering energy from said moving shaft as said shaft moves between said first position and said predetermined location.

13. A system according to claim 12 comprising a lift chamber defining means connected to said shaft within said processing vessel for defining a lift chamber having a bounded volume having an opening disposed opposing a gas inlet, means for admitting gas from said pressurized source to said gas inlet for said gas to be collected within said chamber to urge said shaft free end towards said level of said liquid; and gas discharge means for releasing collected gas from said chamber when said free end of said shaft has moved towards said liquid level to a predetermined location.

14. A system for recovering energy from a high pressure natural gas comprising a processing vessel having wall means defining a bounded volume, said volume at least partially filled with a liquid;

a shaft extending downwardly from said processing vessel through an aperture formed in a bottom wall of said vessel, said shaft having a free end disposed within said processing vessel, means for sealing said aperture and accommodating reciprocating movement of said shaft through said aperture;

a source of high pressurized natural gas;

an expansion tank having a gas inlet for receiving high pressurized natural gas and reducing a pressure of said gas within said expansion tank;

high pressure conduit means for connecting said pressurized gas source in gas flow communication with a gas inlet disposed within said processing vessel beneath a level of said liquid within said vessel for gas admitted to said inlet to have a tendency to flow in a predetermined path from said inlet toward said level of said liquid;

exhaust conduit means for connecting an outlet of said processing vessel in gas flow communication with said gas inlet of said expansion tank, said processing vessel outlet disposed above said level of said liquid;

lift chamber defining means connected to said shaft within said processing vessel for defining a lift chamber having a bounded volume with an opening disposed to admit gas into said lift chamber from gas flowing in said predetermined path, said chamber sized for gas collected within said chamber to lift said shaft against urging of gravity and move said shaft toward said level of said liquid;

gas discharge means for releasing collected gas from said chamber when said chamber has moved to a predetermined location near an upper end of said processing vessel.

* * * * *